United States Patent [19]

Nakamura

[11] 4,095,141

[45] June 13, 1978

[54] ELECTRONIC FLASH DEVICE

[75] Inventor: Zenzo Nakamura, Urawa, Japan

[73] Assignee: Canon Kabushiki Kaisha, Tokyo, Japan

[21] Appl. No.: 658,123

[22] Filed: Feb. 13, 1976

[30] Foreign Application Priority Data

Feb. 21, 1975 Japan ..... 50/21573

[51] Int. Cl.[2] ..... H05B 41/32

[52] U.S. Cl. ..... 315/241 P; 315/159; 354/145

[58] Field of Search ..... 315/151, 159, 241 P; 354/145

[56] References Cited

U.S. PATENT DOCUMENTS

| | | | |
|---|---|---|---|
| 3,502,943 | 3/1970 | Wechsler | 315/241 P X |
| 3,634,725 | 1/1972 | Biber | 315/241 P |
| 3,727,100 | 4/1973 | Kuraishi et al. | 315/151 |
| 3,742,297 | 6/1973 | Peacock | 315/241 P X |
| 3,774,072 | 11/1973 | Ogawa | 315/151 |
| 3,809,954 | 5/1974 | Engelstatter | 315/241 P |
| 3,875,471 | 4/1975 | Buck | 315/151 |

FOREIGN PATENT DOCUMENTS

| | | | |
|---|---|---|---|
| 2,047,527 | 4/1972 | Germany | 315/241 P |

*Primary Examiner*—Eugene R. LaRoche
*Attorney, Agent, or Firm*—Toren, McGeady and Stanger

[57] ABSTRACT

The trigger circuit of an electronic flash device includes a pulse transformer connected to a trigger electrode of a flash tube, a capacitor connected to the pulse transformer, a thyristor connected in the discharge path of the capacitor, and a control circuit for the thyristor. This control circuit is provided with a low-voltage trigger means for applying a trigger pulse to said thyristor and further with a synchronous switch connected therein so that the synchronous switch operates with a low voltage.

7 Claims, 5 Drawing Figures

ELECTRONIC FLASH DEVICE

BACKGROUND OF THE INVENTION

1. Field of the Invention

This invention relates to an electronic flash device, and more particularly to a trigger circuit in the electronic flash device.

2. Description of the Prior Art

Conventional electronic flash devices known, for example, in U.S. Pat. Nos. 3,591,829 and 3,805,278 generally employ a trigger circuit of the type in which an electrical charge stored in a capacitor is caused to rapidly flow through the primary coil of a pulse transformer in response to the closure of a synchronous switch provided in a camera side or of a trigger switch of the electronic flash device, while a high-voltage pulse induced in the secondary coil of the transformer is applied to the trigger electrode of the flash tube and results in a discharge therethrough to emit a flash of light. With such a trigger circuit, a high voltage is directly applied from the electronic flash device to the synchronous switch of the camera, thereby giving a disadvantage of damaging the contacts of the synchronous switch by sparking or the like which may be encountered when the switch is opened or closed. Another disadvantage is that when a camera having an accessary shoe and synchronous terminals arranged in a common body is selected for use with a direct-connection type electronic flash device to make flash photography, a high voltage is applied from the electronic flash device to the synchro-terminals as well, so that if the operator accidentally puts his finger to the synchro-terminals, he will feel an electrical shock.

SUMMARY OF THE INVENTION

An object of the invention is to provide an electronic flash device which has overcome the above mentioned drawbacks of the prior art.

Another object of the invention is to provide an electronic flash device having a trigger circuit which results in low voltage application to both of the synchronous switch and synchro-terminals of a camera associated therewith.

A still another object of the invention is to provide an electronic flash device which operates with an assurance that the flash tube is fired only once at a desired instant in time regardless of the successive accidental closure of the synchronous switch.

Another object of the invention is to provide an electronic flash device with a trigger circuit constructed to apply as a low voltage as less than 1.0 volt to the synchronous switch or trigger switch therefor.

Still another object of the invention is to provide an electronic flash device in which the semiconductor elements of the trigger circuit are protected from damages.

Further more object of the invention is to provide an electronic flash device in which the time lag between the closure of the synchronous switch and the initiation of firing of the flash tube is remarkably decreased.

DESCRIPTION OF THE PREFERRED EMBODIMENTS

Figure 1:
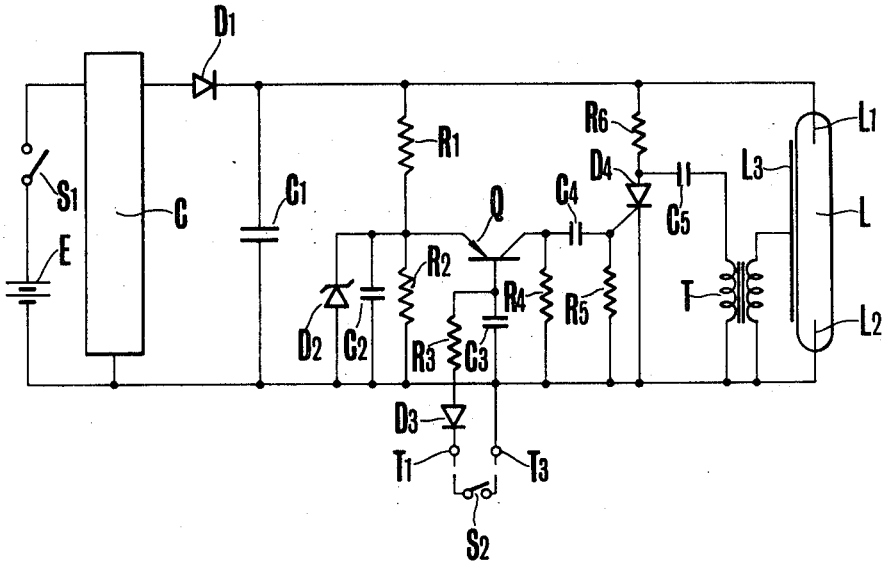
FIG. 1 is a circuit diagram of a first embodiment of an electronic flash device according to the present invention.

Referring to FIG. 1, there is shown a preferred embodiment of the electrical circuitry of an electronic flash device according to the present invention as comprising a battery E as an electrical power source, a direct current voltage booster circuit C connected through a power switch $S_1$ to the battery E, a main storage capacitor $C_1$ connected across the booster circuit C by way of a rectifier diode $D_1$, these parts constituting an electric energy circuit, a flash tube L having an anode electrode $L_1$ connected to a point on connection between one side of the main storage capacitor $C_1$ and the rectifier diode $D_1$, having a cathode $L_2$ connected to the other side of the capacitor $C_1$ and a trigger electrode $L_3$, a trigger circuit for the flash tube L, and a control circuit for the trigger circuit.

The control circuit comprises a voltage divider of series-connected resistors $R_1$ and $R_2$ and connected between the output terminals of the electrical energy circuit, a Zener diode $D_2$ connected across the resistor $R_2$ and providing a Zener voltage which is usually less than 10 volts but may be less than 1 volt, a capacitor $C_2$ connected in parallel with the Zener diode $D_2$, a pnp transistor Q having an emitter electrode connected to the output tap of the voltage divider $R_1$, $R_2$, and having a base electrode connected both to a first synchronous interconnection terminal or synchro-terminal $T_1$ through a resistor $R_3$ and a diode $D_3$ connected in series with each other and to a second synchronous interconnection terminal or synchro-terminal $T_3$ through a capacitor $C_3$, the first and second synchro-terminals $T_1$ and $T_3$ being arranged in the casing wall of the electronic flash device to be connectable with the movable and fixed contact leads of a synchronous switch $S_2$ of a camera when associated with the electronic flash device, and the synchronous switch $S_2$ being arranged to be closed when the camera shutter has reached the fully open position, a high-impedance resistor $R_4$, a differentiation circuit comprising a capacitor $C_4$ and a resistor $R_5$, the parts $R_4$ and $C_4$ also constituting a timing circuit having a time constant of a few milliseconds for assuring that the flash tube L is fired only once at a desired instant in time, and a silicon rectifier diode or thyristor $D_4$ having a gate control electrode connected through the differentiation circuit to the collector electrode of the transistor Q, having an anode electrode connected through a resistor $R_6$ to the cathode electrode of the rectifier diode $D_1$ and having a cathode electrode connected to the negative terminal of the battery E.

The trigger circuit comprises a capacitor $C_5$ having one pole connected to a point on the connection between the resistor $R_6$ and thyristor $D_4$, and a pulse transformer T having a primary coil connected to the other pole of the capacitor $C_5$ and having a secondary coil connected to the trigger electrode $L_3$ of the flash tube L, the charge circuit for the capacitor $C_5$ being made up of the resistor $R_6$.

The operation of the electronic flash device of FIG. 1 is as follows. When the power switch $S_1$ is closed, the voltage of the battery E is increased by the direct current voltage booster circuit C, then rectified by the diode $D_1$, and then applied to the main storage capacitor $C_1$. Thus capacitor $C_1$ is charged to a high voltage. At the same time, the capacitor $C_2$ is charged through the resistor $R_1$ to a voltage equal to the Zener voltage of the Zener diode $D_2$, and the capacitor $C_3$ is also charged through the resistor $R_1$ and the emitter and base electrodes of the transistor Q until the voltage of the capacitor $C_3$ reaches the voltage of capacitor $C_2$. Also the capacitor $C_5$ is charged through the resistor $R_6$ and the primary coil of the transformer T. When the charging of the main capacitor $C_1$ has been completed for assuring the firing of the flash tube L, a charge-completion indicating circuit not shown is operated to display the charge completion state. With the electronic flash device of this state, it is impossible to give an electrical shock to the operator when his finger is accidentally put into contact with the terminals of the synchronous switch $S_2$, because the voltage applied across the terminals of the synchronous switch $S_2$ is so small as to be equal to the voltage of the capacitor $C_3$, namely, a few volts, or less than one volt. This aspect of the electronic flash device of the invention leads to almost no occurrence of sparks which would be otherwise effected when the synchronous switch $S_2$ is closed.

When the synchronous switch $S_2$ of the camera (or the trigger switch of the electronic flash device) is closed, the capacitor $C_3$ is discharged through the resistor $R_3$, diode $D_3$ and switch $S_2$, causing a decrease in the base potential of the transistor Q. Hence the transistor Q which has so far been in the non-conductive state is rendered conducting. When the transistor is turned on, the electrical charge of the capacitor $C_2$ flows through the transistor Ω and charges the capacitor $C_4$ at an extremely rapid rate to a voltage at which the differentiation circuit produces a differential pulse with a magnitude large enough to insure that the thyristor $D_4$ is rendered conductive. Upon actuation of the thyristor $D_4$ by this pulse, the electrical charge of the capacitor $C_5$ is discharged in a pulsating form through the thus-conductive thyristor $D_4$ and the primary coil of the trigger transformer T, causing a very high voltage to be generated in the secondary coil of the transformer T. Thus the flash tube L is triggered and this results in a discharge in the flash tube L which emits an intense flash of light.

It will be appreciated that whilst the prior art provides the synchronous switch $S_2$ as arranged in the discharge path of the trigger capacitor $C_5$, the present invention contemplates the use of a pulse produced by transferring the electrical charge of the capacitor $C_2$ which is supplied from a constant voltage source of the resistors $R_1$ and $R_2$ and the Zener diode $D_2$ to the capacitor $C_4$ in response to the switching operation of the transistor Q. This serves for controlling the discharging operation of the capacitor $C_5$ to actuate the trigger transformer T, so that the synchronous switch $S_2$ of the camera may be operated with application of a very small electrical energy thereto necessary to control the operation of the transistor Q. Therefore, the comsumption of the synchronous switch can be reduced to a very small level, and moreover the shock which the operator feels when he is brought into contact with the synchro-terminals can also be avoided.

Provision is made for insuring that the flash tube L is fired only once at a desired instant in time regardless of the subsequent accidental closure of the synchronous switch $S_2$. Such accidental closure may occur successively one or more times in a specified short period of time, for example, regardless of the occurrence of bounce contact of the synchronous switch $S_2$. The aforementioned provision for a single firing is made at the resistor $R_4$ which has a high impedence and is connected in the discharge path of the capacitor $C_4$. The latter forms the differentiating circuit together with the resistor $R_5$. This mechanism operates as follows. When the synchronous switch $S_2$ is closed to render conducting the transistor Q, which in turn causes conduction of the thyristor $D_4$, the capacitor $C_5$ is instantaneously discharged through the thyristor $D_4$. As soon as the discharging of the capacitor $C_5$ has been completed, the thyristor $D_4$ is rendered non-conducting. Now assuming that the synchronous switch $S_2$ is caused to bounce in a time period shorter than the above identified period after the initial intentional closure of the synchronous switch $S_2$ and to open for a moment, the transistor Q is immediately turned off to permit the discharge of the capacitor $C_4$ through the resistor $R_4$. Because of the high impedance of the resistor $R_4$, a considerable time duration is required until the electrical charge stored on the capacitor $C_4$ is discharged completely. As the synchronous switch $S_2$ is closed after the bounce contact, therefore, the subsequent conduction of transistor Q does not result in application of a trigger impulse to the thyristor $D_4$ for the conduction thereof again.

In order to protect the transistor Q from damage due to the large current flow therethrough, while still permitting the control of the thyristor $D_4$ with a large electrical power, there is provided the voltage divider of the resistor $R_1$ and $R_2$ as arranged so that a very small current is allowed to flow through the resistor $R_1$ from the capacitor $C_1$ to the transistor Q in combination with the capacitor $C_2$ as arranged to provide a large electrical power for the conducting operation of the thyristor $D_4$ with reliability and rapidly. Instead of the use of the voltage divider, it is possible to connect the emitter electrode of the transistor Q directly to the main storage capacitor $C_1$ as in the prior art. In this case, however, although the rapid and reliable transferrence of the thyristor from the non-conducting to the conducting state can be secured, a large current is caused to flow not only through the flash tube L but through the transistor Q and the differentiating circuit from the capacitor $C_1$ with the result that the total flash energy available from the prior art flash device is considerably smaller than that available in the present invention with respect to the equivalent consumption of electrical energy of the power source battery E. According to the present invention, almost all the electrical energy stored on the main storage capacitor $C_1$ is directed to the flash tube L to save a decrease of the total amount of flash energy emitted which would be otherwise effected, and in addition to such an advantage it is possible to achieve rapid striking of the flash tube L with the increased reliability of operation thereof.

Figure 2:
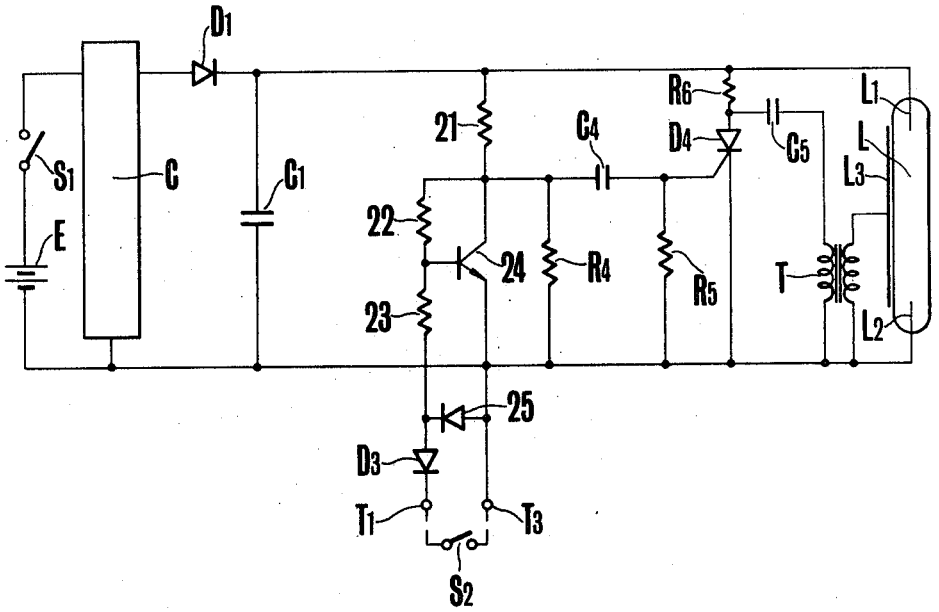
FIG. 2 is a similar diagram of a second embodiment of the invention.

In FIG. 2, there is shown a second embodiment of the electronic flash device according to the present invention, wherein the same reference characters and numerals have been employed to denote the similar parts to those shown in FIG. 1. The circuit of FIG. 2 includes a battery E, a power switch $S_1$, a booster circuit C, a diode $D_1$, a main capacitor $C_1$, a synchronous switch $S_2$, resistors $R_4$ through $R_6$, capacitors $C_4$ and $C_5$, a thyristor $D_4$, a pulse transformer T and a flash tube L, these parts being arranged in the same way as that of FIG. 1. The circuit of FIG. 2 further includes three resistors 21, 22 and 23 connected in series with each other, a npn transistor 24 having a collector electrode connected through the resistor $R_1$ 21 to the cathode electrode of the diode $D_1$, having a base electrode connected to a point on the connection between the resistors 22 and 23 and having an emitter electrode connected to the negative bus and therefrom connected to a second synchro-terminal $T_3$, a diode $D_3$ connected between a first synchro-terminal $T_1$ and the resistor 23, and a reverse current-preventing diode 25 connected between the negative bus and a point on the connection between the resistor 23 and diode $D_3$.

In operation of the device of FIG. 2, when the power switch $S_1$ is closed, the main capacitor is charged to a high voltage. At the same time, a small current is allowed to flow through the resistors 21 and 22 to the base of the transistor 24, thereby the transistor 24 is rendered conducting, and the capacitor $C_5$ is also charged, but the capacitor $C_4$ is not charged because of the conduction of the transistor 24. Next, when the synchronous switch $S_2$ of the camera is closed, the potential of the base electrode of the transistor 24 is dropped to a level almost equal to the potential of the emitter electrode, and the transistor 24 is rendered non-conducting causing a current to flow through the resistor 21, capacitor $C_4$ and the resistor $R_5$, thereby a pulse is produced across the resistor $R_5$. Upon advent of this pulse to the gating control electrode of the thyristor $D_4$, the electrical charge previously stored on the capacitor $C_5$ is caused to flow through the thyristor $D_4$ to the primary coil of the transformer T which is turn causes generation of a high voltage pulse in the secondary coil of the transformer T. When this high voltage pulse is applied to the trigger electrode of the flash tube L, the electrical charge stored on the main capacitor $C_1$ is discharged through the flash tube L for an extremely short time duration to emit an extremely intense flash of light. In this second embodiment, the voltage with which the synchronous switch $S_2$ operates is almost equal to the voltage $V_{BE}$ between the base and emitter electrodes of the transistor 24, so that a similar effect to that of the first embodiment, that is, the operator does not feel an electrical shock on the accidental contact of his hand with the bare terminals of the synchronous switch $S_2$, and furthermore no successive accidental firing of the flash tube can be effected by the bounce contact of the switch $S_2$.

Figure 3:
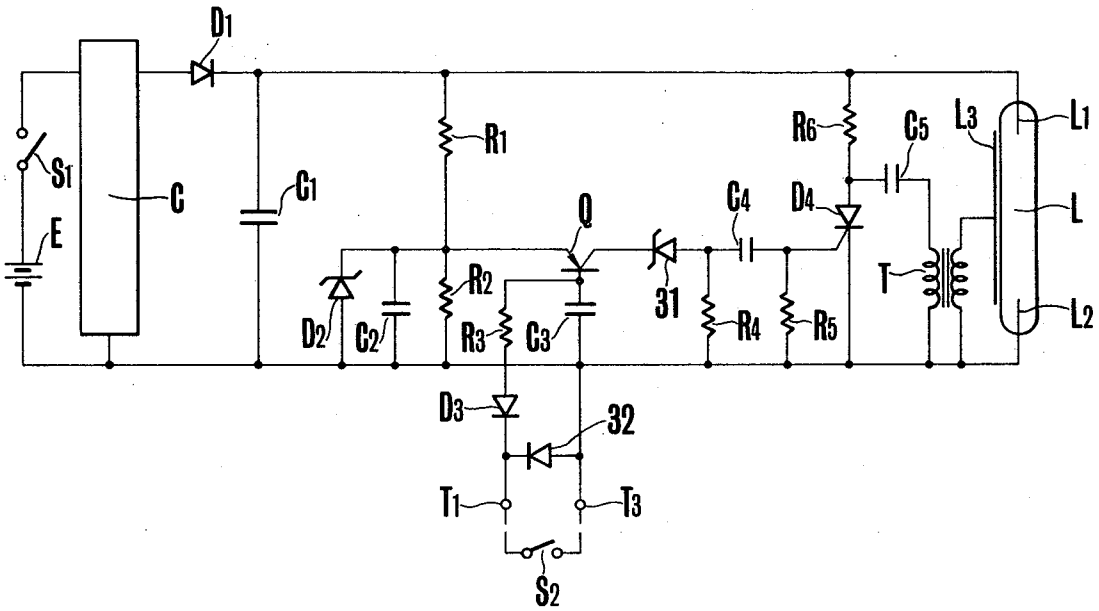
FIG. 3 is a similar diagram of a third embodiment of the invention.
Figure 4:
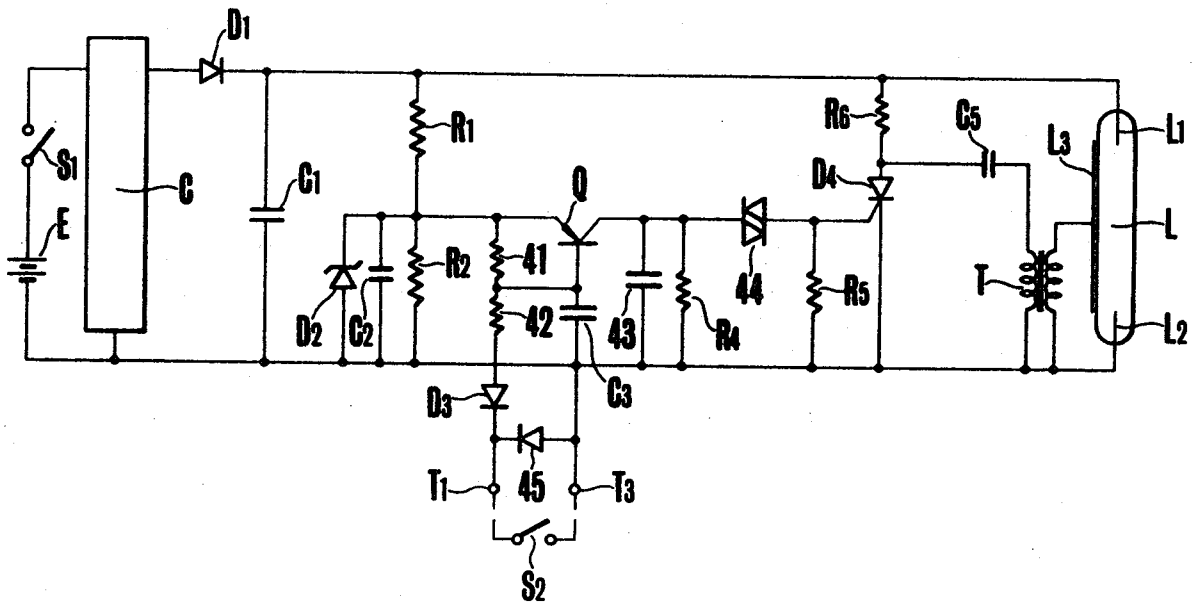
FIG. 4 is a similar diagram of a fourth embodiment of the invention.

FIG. 3 shows a third embodiment of the invention which is different from the first embodiment of FIG. 1 in that a Zener diode 31 is inserted between the collector electrode of the transistor Q and the capacitor $C_4$ of the differentiating circuit, and a reverse current preventing diode 32 is inserted between the first and second synchro-terminals $T_1$ and $T_3$. With this insertion of the Zener diode 31, the gating control electrode of the thyristor $D_4$ is supplied with a pulse of a certain specified voltage level. Instead of using this Zener diode 31, it is possible to use a trigger diode 44 as shown in FIG. 4 wherein 41 and 42 are resistors, and 43 is a capacitor.

Figure 5:
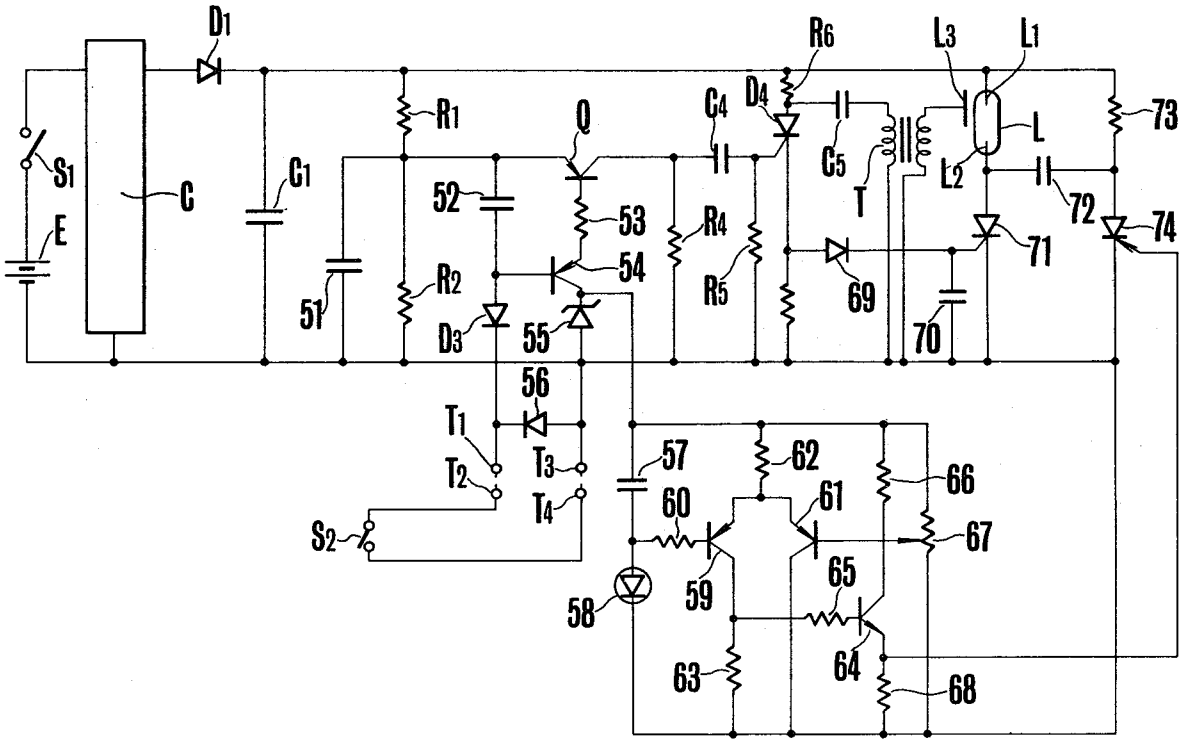
FIG. 5 is a similar diagram of a fifth embodiment of the invention.

Referring to FIG. 5, there is shown a fifth embodiment of an electronic flash device according to the invention as associated with a firing time control circuit, wherein the power supply and trigger circuits and the control circuit for the trigger circuit of the fifth embodiment remain substantially unchanged from the first embodiment, and wherein the same reference characters and numerals have been employed to denote the similar parts to those of the first embodiment. In FIG. 5, there is shown a capacitor 51 connected across the resistor $R_2$ of the voltage divider, and another capacitor 52 connected between the emitter electrode of transistor Q and the base electrode of a pnp transistor 54 having an emitter electrode connected through a resistor 53 to the base electrode of the transistor Q and having a collector electrode connected through a Zener diode 55 to the negative bus. The base electrode of the transistor 54 is further connected through a diode $D_3$ to the first synchro-terminal $T_1$.

The firing time control circuit comprises a sensor circuit, a difference type comparator circuit and a switching circuit for controlling the period of energization of the flash tube L in accordance with the level of brightness of an object being photographed. The sensor circuit comprises an integrating capacitor 57 and a light sensitive element 58 such as a photovoltaic cell connected in series with the capacitor 57 and arranged to receive light coming from the object with illumination of flash light. The output of the sensor circuit is connected through a resistor 60 to the base electrode of a pnp transistor 59 constituting part of the difference type comparator. The comparator further includes a pnp transistor 61 having an emitter electrode connected both to a point on the connection between the Zener diode 55 and the collector electrode of the transistor 54 through a resistor 62 and to the emitter electrode of the transistor 59, a variable resistor 67 having a slidable tap connected to the base electrode of the transistor 61 to set into the comparator an exposure control parameter value dependent upon the film speed, aperture value and the like, and an output stage resistor 63 connected to the collector electrode of the transistor 59. The switching circuit includes a npn transistor 64 having a base electrode connected through a resistor 65 to the output terminal of the comparator, having a collector electrode connected to a resistor 66, and having an emitter electrode connected through a resistor 68 to the negative bus, and also connected to a gating control electrode of a first thyristor 74. The switching circuit further includes a second thyristor 71 connected in series with the flash tube L and having an anode electrode connected through a commutation capacitor 72 to a point on the connection between a resistor 73 and the anode electrode of the first thyristor 74, the resistor 73 serving as a charging path for the capacitor 72. The gating control electrode of the second thyristor 71 is connected both to the negative bus through a capacitor 70 and to a point on the connection between the cathode of the thyristor $D_4$ and a resistor through a diode 69. $T_2$ and $T_4$ are synchro-terminals arranged in a hot shoe of a camera to be connectable with the respective synchro-terminals $T_1$ and $T_3$ extending out of the electronic flash device. $S_2$ is a synchronous switch mentioned above having movable and fixed contact members connected to the synchro-terminals $T_2$ and $T_4$ respectively.

The operation of the circuit of FIG. 5 is as follows. When the power switch $S_1$ is closed, the capacitors $C_1$, $C_5$ and 51 are charged. In this state, it is of no electrical shock for the operator to put his finger on the synchro-terminals $T_1$ and $T_3$ at the same time, because of the application of a low voltage thereto almost equal to the voltage $V_{BE}$ between the base and collector electrodes of the transistor 54.

With the electronic flash device assembled with the camera at the synchro-terminals in the hot shoe as shown in FIG. 5, when the synchronous switch $S_2$ is closed, the transistors 54 and Q are supplied with currents at their base electrode, and simultaneously rendered conducting. At the time when the transistor Q is rendered conducting, the electrical charge stored on the capacitor 54 is initiated to be rapidly discharged through the transistor Q, capacitor $C_4$ and resistor $R_5$, thereupon a pulse is produced across the resistor $R_5$. Upon advent of this pulse to the thyristor $D_4$, the thyristor $D_4$ is rendered conducting to permit a rapid discharging of the electrical charge previously stored on the capacitor $C_5$ through the resistor and the primary coil of the transformer T which in turn causes generation of a high voltage pulse in the secondary coil of the transformer T. This high voltage pulse is applied to the trigger electrode $L_3$ of the flash tube L. On the other hand, the conduction of the thyristor $D_4$ results in application of a pulse to the gating control electrode of the thyristor 71, thereby a fraction or all of the electrical energy stored on the main capacitor $C_1$ is allowed to be discharged through the flash tube L and the thyristor 71 to emit a flash of light for a time duration as determined by the flash time control circuit.

As the transistors Q and 54 are rendered conducting, a drive voltage is produced across the Zener diode 55, thereby the flash time control circuit is rendered operative. Responsive to the light reflected from the object being photographed with illumination of the flash light from the flash tube L, the light sensitive element 58 produces a photo-current which is then integrated by the capacitor 57. When the output voltage of this integrator circuit reaches a reference voltage set in the variable resistor 67, the transistor 64 is rendered conducting to produce a voltage across the resistor 68, which is applied to the thyristor 74. When the thyristor 74 is rendered conducting, the electrical charge stored on the commutation capacitor 72 is applied through the thyristor 74 to the cathode of the thyristor 71, thereby the thyristor 71 is rendered non-conducting to terminate the duration of energization of the flash tube L. As a result, the exposure of the film not shown in the camera is controlled in accordance with the level of brightness of the object as sensed by the light sensitive element 58 and other preselected exposure control parameter values.

As shown above, according to the present invention, the electronic flash device is so designed to apply to the synchro-terminals or synchronous switch a low voltage, for example, a few volts available as a Zener voltage of a Zener diode, or as a voltage between the emitter and base electrodes of a transistor, or less than 1 volts available as a voltage between the base and collector electrodes of a transistor, so that even when the operator puts his finger on the synchro-terminals or synchronous switch without caution, he feels no electrical shock. Furthermore, almost no sparks are caused to occur so that the wearing out of the terminals is prevented, and no error firing of the flash tube due to the bounce contact of the synchronous switch can be effected. Such advantages become move valuable particularly when an additional flash tube or tubes is or are used in combination with the intrinsic flash tube.

A further feature of the invention is that the initiation of firing of the flash tube L is effected in a sufficiently short period of time after the closure of the synchronous switch $S_2$ by the provision of a capacitor $C_2$ or 51 to prevent the flash exposure from being made in a particular region of the image, the other region of which is exposed under day-light illumination along, as being often encountered in the prior art.

What is claimed is:

1. An electric flash device for a camera comprising:

(a) flash means for producing a light energy and having trigger and cathode electrodes;

(b) a capacitor coupled to said flash means for storing an electrical energy to be converted into the light energy in said flash means;

(c) a voltage divider circuit connected in parallel with said capacitor and having an output terminal;

(d) trigger pulse producing means coupled to said trigger electrode for supplying a trigger pulse to the trigger electrode of said flash means and including a thyristor having a control electrode;

(e) a PNP transistor coupled to the voltage divider circuit for impressing a voltage derived from the voltage divider circuit on the control electrode of said thyristor; the transistor having an emitter electrode connected to an output terminal of the voltage divider circuit, a collector electrode connected to the control electrode of said thyristor and a base electrode;

(f) a camera flash synchronizing switch connected to said base electrode of said PNP transistor for actuating the PNP transistor; and (g) a one-way conductive element connected in series with said synchronizing switch to prevent high voltages at the synchronizing switch from appearing at said PNP transistor.

2. An electric flash device for a camera comprising:

(a) a flash tube for producing a light energy and having trigger and cathode electrodes;

(b) a capacitor coupled to said flash tube for storing electrical energy to be converted into the light energy in said flash tube;

(c) a resistor divider circuit connected in parallel with said capacitor;

(d) trigger pulse producing means coupled to said trigger electrode for supplying a trigger pulse to the trigger electrode of said flash tube and including a thyristor having a control electrode;

(e) a PNP type transistor coupled to said divider circuit and said pulse producing means for impressing a divided voltage from the resistor divider circuit on the control electrode of said thyristor; the transistor having an emitter electrode connected to an output terminal of the resistor divider circuit, a collector electrode connected to the control electrode of said thyristor and a base electrode;

(f) electric energy storage means connected between the base electrode of said PNP type transistor and the cathode electrode of said flash tube;

(g) camera synchronizing switch connected in parallel with said electric energy storage means for actuating the PNP type transistor; and (h) a one-way conductive element connected in series with said synchronous switch for preventing high voltage application from the synchronizing switch onto the PNP type transistor.

3. An electric flash device according to claim 2, wherein said one-way conductive element is a diode.

4. An electric flash device according to claim 2, wherein said one-way conductive element includes a diode having an anode electrode connected to the base electrode of said transistor.

5. An electronic flash device according to claim 2, further comprising a differentiation circuit connected between the collector electrode of said transistor and the control electrode of said thyristor for supplying the thyristor with a differentiation pulse to energize the thyristor.

6. An electronic flash device according to claim 1, wherein said resistor divider circuit includes a pair of resistors, and further comprising:

a Zener diode connected in parallel to one of said resistors of said resistor divider circuit to supply a constant voltage to said transistor.

7. An electronic flash device according to claim 6, further comprising capacitor means connected in parallel with said Zener diode.

* * * * *